US005431003A

United States Patent [19]

Raasch

[11] Patent Number: 5,431,003

[45] Date of Patent: Jul. 11, 1995

[54] METHOD AND APPARATUS FOR CHANGING THE SLIVER CANS OF AN AUTOMATIC SPINNING MACHINE

[75] Inventor: Hans Raasch, Mönchengladbach, Germany

[73] Assignee: W. Schlafhorst AG & Co., Moenchengladbach, Germany

[21] Appl. No.: 235,205

[22] Filed: Apr. 29, 1994

Related U.S. Application Data

[63] Continuation of Ser. No. 760,484, Sep. 16, 1991, abandoned.

[30] Foreign Application Priority Data

Sep. 15, 1990 [DE] Germany ..... 40 29 303.3

[51] Int. Cl.[6] ..... D01H 9/10; D01H 9/08

[52] U.S. Cl. ..... 57/281; 19/159 A; 57/90; 57/268

[58] Field of Search ..... 19/159 A; 57/281, 90, 57/268, 266, 270

[56] References Cited

U.S. PATENT DOCUMENTS

| | | | |
|---|---|---|---|
| 4,083,170 | 4/1978 | Raasch | 57/281 |
| 4,150,534 | 4/1979 | Raasch | 57/281 |
| 4,208,768 | 6/1980 | Bonner | 57/281 X |
| 4,694,539 | 9/1987 | Langen | 19/159 A |
| 4,735,040 | 4/1988 | Pircher | 57/90 X |
| 4,932,201 | 6/1990 | Meroni et al. | 57/90 X |
| 4,972,669 | 11/1990 | Raasch | 57/90 X |
| 4,977,738 | 12/1990 | Stahlecker | 57/90 X |
| 4,998,406 | 3/1991 | Raasch | 19/159 A X |
| 5,081,744 | 1/1992 | Siegenthaler et al. | 57/90 X |
| 5,138,828 | 8/1992 | Stahlecker | 57/281 |

FOREIGN PATENT DOCUMENTS

| | | | |
|---|---|---|---|
| 3634683 | 4/1988 | Germany . | |
| 3831638 | 3/1990 | Germany . | |
| 2145122 | 3/1985 | United Kingdom | 19/159 A |
| 8606358 | 11/1986 | WIPO . | |

*Primary Examiner*—Daniel P. Stodola
*Assistant Examiner*—William Stryjewski
*Attorney, Agent, or Firm*—Herbert L. Lerner; Laurence A. Greenberg

[57] ABSTRACT

In a method and apparatus for supplying sliver cans to an automatic spinning machine and removing empty sliver cans from spinning stations of the automatic spinning machine, a can transport carriage to be driven between the automatic spinning machine and a can delivery station or empty can receiving station has can parking places for a can supply. An empty can below a spinning station is removed, placed on a free parking place, and replaced with a filled can from the can supply which is placed under the spinning station, all through the use of an automatic can changer. Two associated sliver cans are placed in succession forming two successive rows of front and rear sliver cans for supplying two adjacent spinning stations with sliver. Two free parking places are maintained for sliver cans on the can transport carriage. A rear can of a pair of cans located under a pair of spinning stations is changed by initially loading both cans of the pair onto the two free parking places with the can changer, regardless of whether or not the front can is still delivering sliver to a spinning station of the pair of spinning stations. The empty rear can of the pair of cans is then replaced with a full can. A front can of the pair of cans that may still be delivering sliver is subsequently returned to a position below the pair of spinning stations with the can changer.

22 Claims, 3 Drawing Sheets

FIG. 4
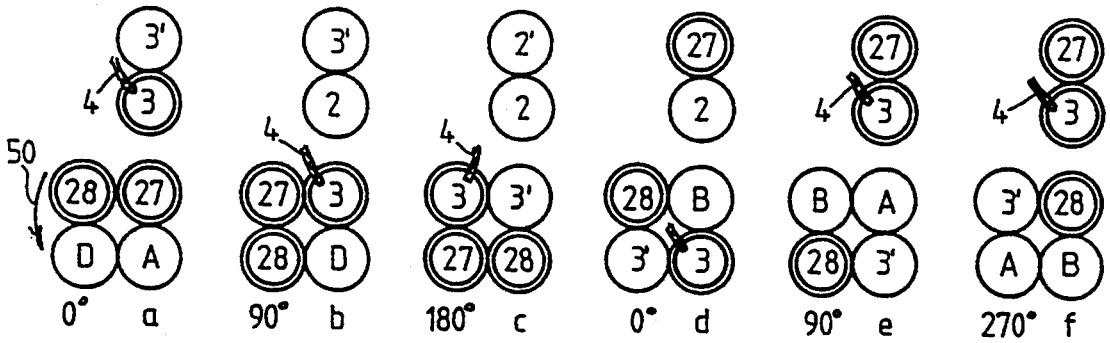
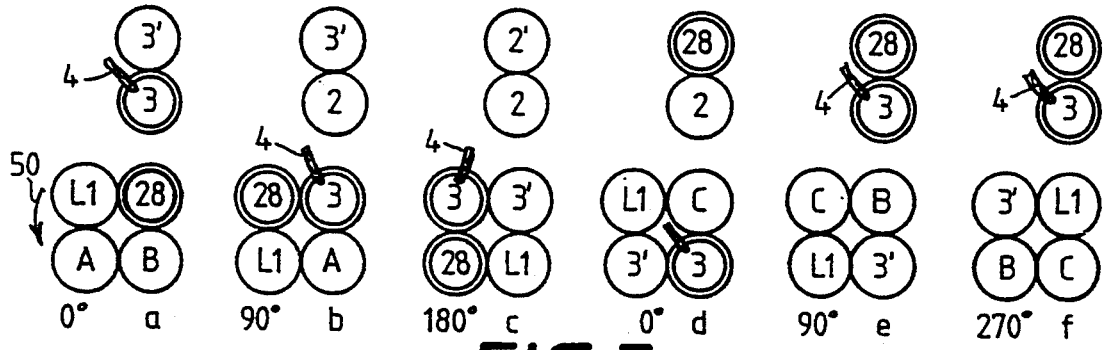
FIG. 5
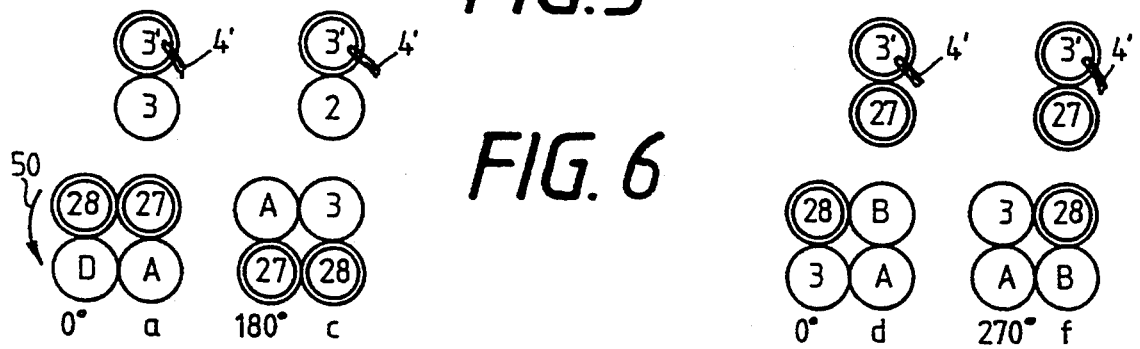
FIG. 6
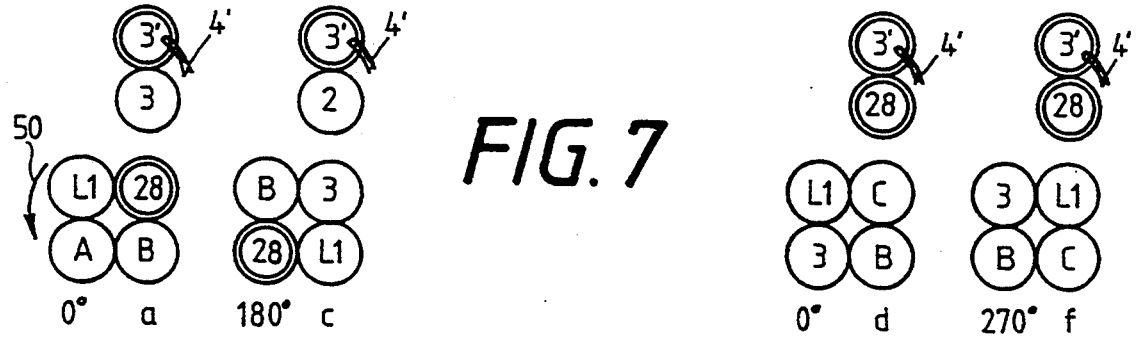
FIG. 7

METHOD AND APPARATUS FOR CHANGING THE SLIVER CANS OF AN AUTOMATIC SPINNING MACHINE

This application is a continuation of application Ser. No. 07/760,484, filed Sep. 16, 1991, now abandoned.

BACKGROUND OF THE INVENTION

1. Field of the Invention

The invention relates to a method and apparatus for supplying an automatic spinning machine with filled sliver cans and for removing the cans that become empty at the spinning stations with the aid of a can transport carriage, which can be driven between the automatic spinning station and a can delivery station or empty can receiving station and which has can parking places and an automatic can changer, wherein the can changer removes an empty can located below a spinning station of the automatic spinning machine and places it on a free parking place of the can transport carriage, and replaces it with a filled can from the can supply of the can transport carriage which it places under the spinning station.

2. Description of the Related Art

Such an apparatus is known from German Published, Non-Prosecuted Application DE 38 31 638 A1, corresponding to U.S. Pat. No. 4,998,406. The known apparatus relates to a can transport carriage having a turntable on which the cans stand. At the automatic spinning machine, all of the sliver cans stand in a row, and a can changing apparatus of the can transport carriage exchanges one empty can at a time with a can it has brought.

However, the can transport carriage is only suitable for sliver cans of relatively small diameter, which cannot be larger than the center spacing of adjacent spinning stations of an automatic spinning machine.

It is accordingly an object of the invention to provide a method and an apparatus for changing the sliver cans of an automatic spinning machine, which overcome the hereinafore-mentioned disadvantages of the heretofore-known methods and devices of this general type and which can be used to change sliver cans having a diameter substantially larger than the center spacing between two adjacent spinning stations.

SUMMARY OF THE INVENTION

With the foregoing and other objects in view there is provided, in accordance with the invention, in a method for supplying an automatic spinning machine with filled sliver cans and for removing the cans that become empty at the spinning stations with the aid of a can transport carriage, which can be driven between the automatic spinning station and a can delivery station or empty can receiving station and which has can parking places and an automatic can changer, wherein the can changer removes an empty can located below a spinning station of the automatic spinning machine and places it on a free parking place of the can transport carriage, and replaces it with a filled can from the can supply of the can transport carriage which it places under the spinning station, the improvement which comprises supplying two adjacent spinning stations in the automatic spinning machine with sliver by placing the two associated sliver cans in succession, so that there are two successive rows of sliver cans in the automatic spinning machine; keeping two parking places free on the can transport carriage for sliver cans; and using the can changer, upon changing a rear can of a pair of cans located under a pair of spinning stations, to initially load both cans of the pair onto the two free parking places of the can transport carriage, regardless of whether or not the front can is still delivering sliver to a spinning station of the pair of spinning stations, then replacing the empty rear can of the pair of cans with a full can, and subsequently optionally returning the front can of the pair of cans still delivering sliver to below the pair of spinning stations with the can changer.

However, if the front can is also no longer delivering sliver, then it would not have to be returned and could then be replaced by a filled can as well.

It is intrinsically not novel to set up the sliver cans of an automatic spinning machine in two successive rows. It has also already been proposed to form a pair of cans from each two successive cans and to dispose the pair on a carriage or cart located under two adjacent spinning stations, and to change cans by to pulling the carriage out from under them and then driving it back to its old place again after the can change.

It has also already been proposed to place a group of four sliver cans on a turntable under four adjacent spinning stations at a time. In order to change a sliver can located at the rear, the turntable is rotated in such a way that the empty sliver can moves to the front, where it can be replaced with a filled can. However, such equipment is very expensive, if for no other reason than because of the great number of turntables required.

As compared with known configurations, the invention has the advantage of simplicity and reduced engineering expense.

In accordance with another mode of the invention, there is provided a method which comprises orienting the can changer in an aligned manner in front of a pair of cans reporting a need to be changed; then one can after another is transported from the pair of spinning stations to the can transport carriage or in the opposite direction by the can changer; and the can changer makes either a filled can or a free parking place available on the can transport carriage, by means of a parking place changer for each transport event.

In accordance with a further mode of the invention, there is provided a method which comprises controlling the can changer and/or the parking place changer either with a sensor or in accordance with a predetermined can changing program that coordinates its movements.

In accordance with an added mode of the invention, there is provided a method which comprises recognizing with the sensors whether the rear can or the front can of a pair is empty and has to be changed. The can changer and/or the parking place changer is then controlled accordingly. For instance, a sensor can ascertain which parking place on the can transport carriage is free, so that this parking place can first be made available to the can changer. Then, the can changer can either fill the parking place made available to it with the can that is to be changed, or if the can to be changed is located in the back row, it can fill that parking place with the can of the pair that is still delivering sliver. If that is the case, the second parking place that is still free on the can transport carriage will be made available first to the can changer, and this place will be filled with the empty can to be changed. Subsequently, the temporarily received can of the pair of spinning stations that is still furnishing sliver is presented to the can changer, so that it can be transported back underneath the spinning stations.

Sensors can always distinguish between free parking places and filled or empty cans, and specifically between cans that are located in the automatic spinning machine and those that are located on the can transport carriage.

Alternatively, in accordance with an additional mode of the invention, there is provided a method which comprises starting a program control, which requires merely that a finding be made as to whether a front or a rear can should be changed, on the basis of a sensor or a report originating in the automatic spinning machine. The way in which the change is then made can already be defined by program. In that case, under some circumstances, no sensors are necessary.

In accordance with an additional mode of the invention, there is provided a method which comprises providing different variants of the course of motion in the can changing program, depending on whether a rear can or a front can of a pair of cans is being changed.

Different variants in the can changing program are advantageous, particularly because the changing process can be shortened if a front can is to be changed. On the other hand, each changing operation would then proceed according to one and the same plan, and sensors would either have to, or could only, ascertain and decide which can of the pair has to be changed after both cans have been received by the can transport carriage.

In accordance with yet another mode of the invention, there is provided a method which comprises driving a turntable in controlled fashion on the can transport carriage, as the parking place changer, with at least four can parking places disposed about its pivot point; and keeping two parking places free from the outset when the turntable is loaded at a can delivery station. These parking places that are to be kept free need not be located side by side, as long as it is assured that they can each be detected by a sensor. The turntable, which is rotating clockwise or counterclockwise, can then be positioned in whatever way is most advantageous for the can changer for changing purposes.

In accordance with yet a further mode of the invention, there is provided a method which comprises loading the turntable with filled or emptied cans in such a way that after the ending of the loading or changing process, the free parking places on the turntable are located adjacent one another. As will be described in detail below, this has advantages in terms of process technology.

In accordance with yet an added mode of the invention, there is provided a method which comprises, upon each can changing operation, placing the empty can, as the last can of a row of cans, on the turntable, and releasing the first can of the row of cans. This procedure likewise has advantages in terms of process technology, as will be explained in detail below.

As a result, it is in particular advantageously possible for the turntable to always be rotated onward in only one direction, yet without requiring sensors to monitor this movement.

In accordance with yet an additional mode of the invention, there is provided a method which comprises, before changing a rear can of a pair of cans, initially placing the front can, still delivering sliver, on the turntable next to the filled can to be released; then placing the empty can beside the can still delivering sliver; subsequently releasing the filled can; and finally returning the can still delivering sliver to its place below the pair of spinning stations.

The particular advantage of this variant method is that all of the method steps are the same, regardless of whether the first can or the $n^{th}$ can is being delivered to a pair of spinning stations from the can transport carriage.

In accordance with again another mode of the invention, there is provided a method which comprises successively moving the turntable, when a can is being changed, to positions in which a can or a free parking place, as needed, is located at an advantageous can transfer point for the can changer. The turntable can, for instance, be moved into detent positions, which correspond to certain predetermined rotational angles.

In accordance with again a further mode of the invention, there is provided a method which comprises guiding a moving sliver over the can rim and outside or underneath the transport or gripper elements of the can changer, whenever a can still delivering sliver is temporarily placed on the can transport carriage.

The advantage of proceeding in this way is that the moving sliver does not needlessly come into contact with parts of the can transport carriage. The traveling sliver is guided with as little interference as possible. The can changer acts in such a way that it does not impede the travel of the sliver.

With the objects of the invention in view, there is also provided, in an apparatus for supplying an automatic spinning machine with filled sliver cans and for removing the cans that become empty at the spinning stations with the aid of a can transport carriage, which can be driven between the automatic spinning machine and a can delivery station or empty can receiving station and which has can parking places, and an automatic can changer, the improvement comprising two successive sliver cans being disposed under each two adjacent spinning stations and each can furnishing its sliver to one of the two spinning stations of the pair of spinning stations; two can parking places being kept free on the can transport carriage; and the automatic can changer being disposed and programmed in such a way that prior to changing the rear can of a pair of cans of the automatic spinning machine, it first loads both cans of the pair of cans onto the two free parking places of the can transport carriage, regardless of whether or not the front can of the pair of cans is still delivering sliver to a spinning station of the associated pair of spinning stations, then it replaces the empty can with a filled can, and subsequently optionally or as applicable, returns the front can of the pair of cans that is still delivering sliver to its parking place.

In accordance with another feature of the invention, the successive sliver cans forming a pair of cans below the spinning stations are positioned by means of guide rails or rails disposed laterally beside them. This makes it easier for the can changer of the can transport carriage to remove the cans from or introduce them to a position underneath the pair of spinning stations, as applicable.

In accordance with a further feature of the invention, the can transport carriage has a positioning device that positions the carriage in such a way that its can changer is in alignment with the pair of cans of the pair of spinning stations, for changing the cans.

The engineering expense for the can transport carriage is reduced if, in accordance with as added feature of the invention, the can changer is disposed for the successive transport of individual cans from the pair of spinning stations to the can transport carriage, and vice versa. The succession of manipulations required for this prevents parts from getting into each other's way, and thus prevents the problems that might otherwise ensue.

In accordance with an additional feature of the invention, the can transport carriage has a parking place changer, which makes either a filled can or a free parking place available to the can changer, for each changing operation.

In accordance with yet another feature of the invention, there is provided at least one sensor which recognizes and/or can distinguish among empty cans, filled cans, and free parking places, whether or not sliver is running into the spinning station, the sensor controlling the positioning device and/or the can changer and/or the parking place changer.

In accordance with yet a further feature of the invention, there is provided a programmable control device for the can changer and/or the parking place changer, which control device coordinates and controls the movements of the operating elements of the parking place changer or can changer in accordance with a predetermined can changing program. This kind of coordination and control may be provided in such a way that it is largely possible to do without sensors. This depends entirely on the effectiveness of the control program.

In accordance with yet an added feature of the invention, different variants of the course of movement are provided in the changing program, depending on whether a rear can or a front can of the pair of cans is to be changed.

For instance, the change of parking place on the can transport carriage could be accomplished in such a way that the cans are placed in a circle on an underlay, and an indexing star could push the parked cans onward in a circle on the underlay.

However, in accordance with yet an additional feature of the invention, the parking place changer has a turntable being drivable in controlled fashion, which has at least four parking places for cans being disposed around its pivot axis, two of which parking places remain free during can transport. A turntable is simpler to manipulate than an indexing star. Loading of the cans is also generally more easily accomplished from a turntable.

In accordance with again another feature of the invention, there is provided a predetermined can transfer point for the can changer on the can transport carriage, the parking place changer being successively controllable in such a manner that a can or a free parking place is located at or below the can transfer point, as needed for a can transfer operation. The parking place changer operates systematically toward the can changer, and vice versa.

It is characteristic for the apparatus according to the invention that from one case to another the can transport carriage will temporarily receive a can that is still delivering sliver. In order to ensure that there will be no complications in that case and that unimpeded sliver travel will remain assured, in accordance with a concomitant feature of the invention, the can changer operates in a plane that is located above the can parking area, and its manipulating or gripper elements are likewise movable to a plane located above the can parking area, after the end of a manipulation operation. Traveling sliver can be moved underneath these planes and can pass the outside of the gripper elements, and the change of positions of the cans can also proceed unimpeded.

Other features which are considered as characteristic for the invention are set forth in the appended claims.

Although the invention is illustrated and described herein as embodied in a method and an apparatus for changing the sliver cans of an automatic spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 4–7 are top-plan views showing an incremental change in position when the cans are changed.

DESCRIPTION OF THE PREFERRED EMBODIMENT

Figure 3:
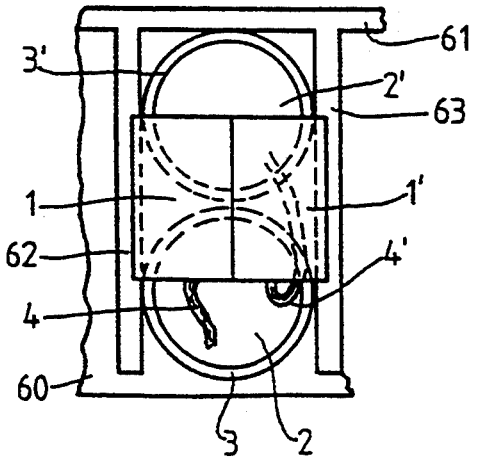
FIG. 3 is a fragmentary, top-plan view showing a relationship between a pair of cans and a pair of spinning stations.

Referring now to the figures of the drawing in detail and first, particularly, to FIG. 3 thereof, there is seen a pair of diagrammatically indicated spinning stations 1, 1' of an automatic spinning machine, which is not otherwise shown. All of the spinning stations or pairs of spinning stations of the automatic spinning machine are disposed in a row. Parking places 2, 2' of a pair of sliver cans 3, 3' are located under the pair of spinning stations 1, 1'. Sliver 4 runs into the spinning station 1 from the sliver can 3, and sliver 4' runs into the spinning station 1' from the sliver can 3'.

The pair of cans 3, 3' stands on a platform 60, on which guide rails 61, 62, 63 for positioning the cans or pairs of cans 3, 3' are disposed.

Figure 1:
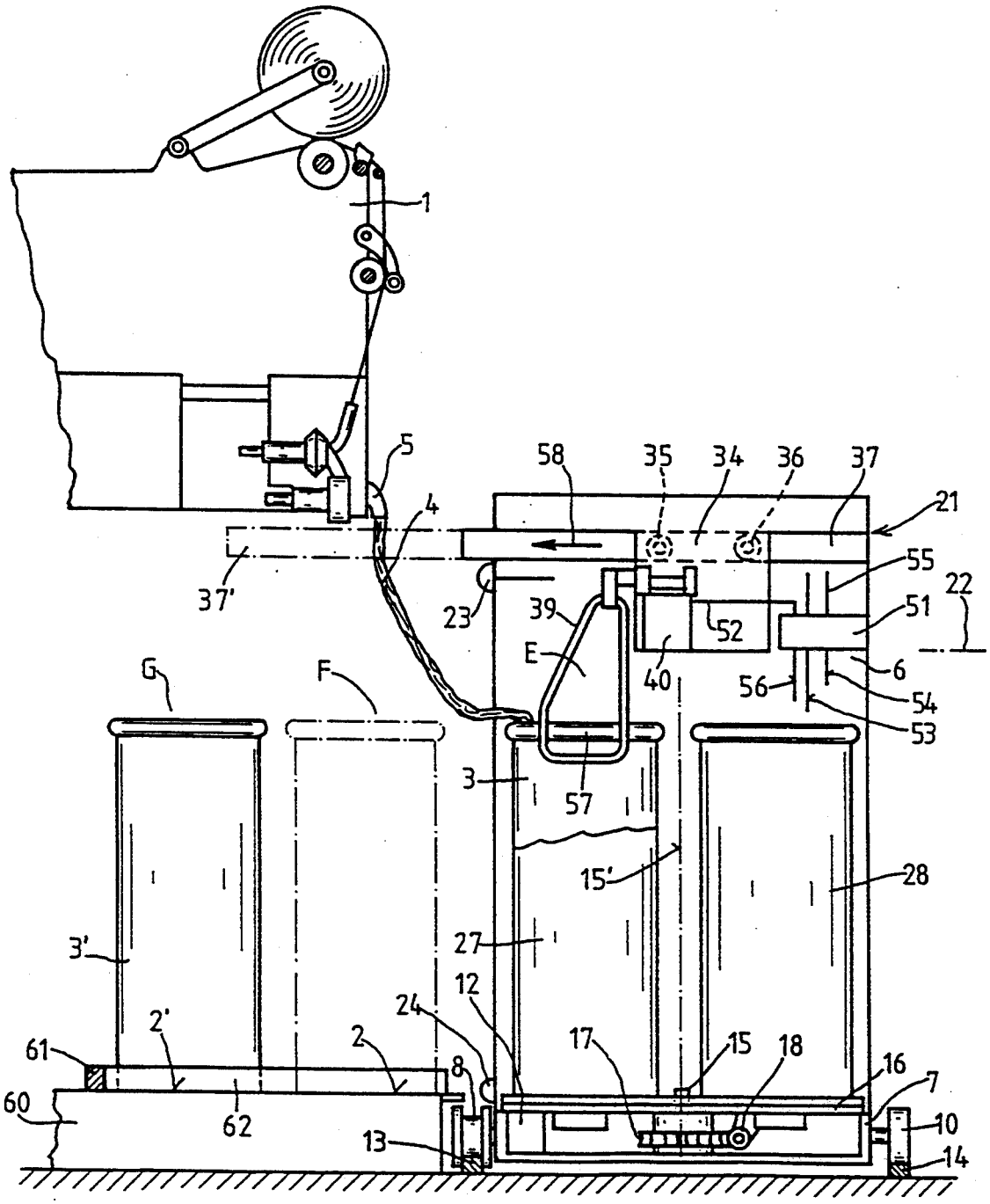
FIG. 1 is a fragmentary, diagrammatic, partly-sectional, side-elevational view of a spinning station with a can transport carriage parked in front of it.
Figure 2:
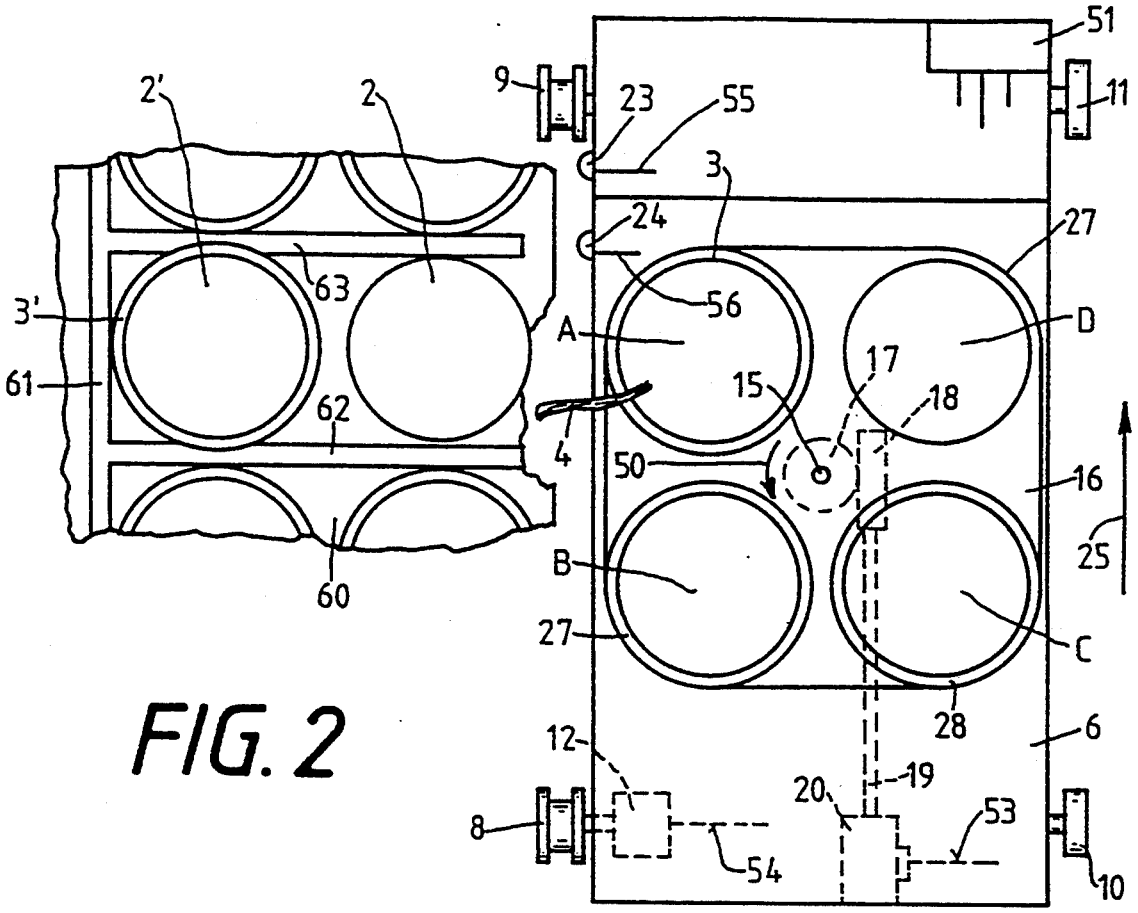
FIG. 2 is a fragmentary, top-plan view of the can transport carriage and the can parking area of an automatic spinning machine to which the spinning stations shown in FIG. 1 belong.

In FIGS. 1 and 2, the sliver can 3' has already run empty. It should be changed, and for this purpose, the sliver can 3 located in the front row in front of it and from which sliver 4 continues to feed into an inlet neck 5 of the spinning station 1, has already been brought to a can transport carriage 6 parked in front of the pair of spinning stations 1, 1'. The previous location of the can 3 is shown in phantom lines in FIG. 1.

The can transport carriage 6 has an undercarriage 7, which carries two flanged rollers 8, 9 and two plain rollers 10, 11. The flanged roller 8 is drivable by a motor 12 acting as a positioning device. The carriage 6 is movable along the spinning stations of the automatic spinning machine on rails 13, 14.

An upright shaft 15 of a turntable 16 is supported on the undercarriage 7. Four can parking places A, B, C and D are provided on the turntable 16. The parking places A, B, C, D are each equidistant from one another. They are also equidistant from the pivot shaft 15 of the turntable 16.

The turntable 16 and an electric motor 20 belong to a parking place changer. A worm wheel 17, with which a screw 18 meshes, is joined to the turntable 16. The screw 18 is joined to the parking place changer 20 through the use of a shaft 19. The aforementioned can 3 is parked on the parking place A, a filled can 27 is parked on the parking place B, and a filled can 28 is parked on the parking place C.

A can changer, which is shown only in FIG. 1 and is identified overall by reference numeral 21, operates above the parking places A and D. The can changer 21 has a manipulator 34, which can be moved to the pair of spinning stations 1, 1' and back away from them again on rollers 35, 36 along a rail 37 that can be extended in telescoping fashion as far as a position 37'. The manipulator 34 has two controllable can grippers, of which only a front can gripper 39 is visible in FIG. 1. A rear can gripper is hidden by the front can gripper 39. The two can grippers can be swiveled upward as far as a plane 22 indicated by phantom lines. This is accomplished by the manipulator 34 whenever the can grippers are located at the level of a pivot axis 15' of the turntable 16 where the upward swiveling can be executed unhindered, for instance between the parking places A and D. However, in order to manipulate the cans, the can grippers are pivoted into the position shown in FIG. 1. It is seen that at least four parking places for cans are placed about a pivot point of the turntable along the pivot axis.

In FIG. 1, the can grippers 39 are located at a transfer point E, which is disposed vertically above the parking place A. The manipulator 34 can be moved forward by a drive apparatus 40 with telescoping extension of the rail 37 in the direction of an arrow 58, far enough so that the can grippers 39 are selectively moved as far as a loading position F or G. The loading position F is located vertically above the parking place 2, and the loading position G is located vertically above the parking place 2'.

The parking place changer 20 is successively controllable in such a way that for one can transfer operation, either a can or a free parking place, for instance the parking place A or D, as needed, is located below the can transfer point E. In the present case, the parking place changer 20 is disposed in such a way that it rotates the turntable 16 either by 90° at a time or by a multiple of 90° in the direction of an arrow 50. Further details regarding this point will be given below.

A programmed control device 51 is provided for the parking place changer 20, the can changer 21, and the motor 12 serving as a positioning device. The device 51 controls and coordinates the movements of the operating elements of these various devices in accordance with a predetermined can changing program, which is programmed into the control device 51 with different variants of the course of movement. The control device is a conventional one which works, for instance, with interchangeable cam plate sets, with the aid of which automatic sequencing of the various work steps can be preprogrammed as usual for textile machines. Switches are actuated in succession, for instance. As a substitute, the control unit 51 may use electromechanical or electronic components for this sequencing.

Two sensors 23 and 24 are provided for controlling the positioning device 12. These sensors are photoelectric barriers. The photoelectric barrier 23 furthermore controls the selection of the particular action program of the can changer 21.

Furthermore, leading from the control device 51 is an operative connection 52 with the drive mechanism 40 of the manipulator 34, an operative connection 53 with the parking place changer 20, an operative connection 54 with the positioning device 12, an operative connection 55 with the sensor 23, and an operative connection 56 with the sensor 24.

The apparatus shown in FIGS. 1 through 3 functions as follows:

The can transport carriage 6 drives along the spinning stations of the automatic spinning machine on the rails 13 and 14, parallel to the direction of an arrow 25. The photoelectric barrier 23 observes the travel of the sliver, for instance the travel of the sliver 4 and the sliver 4' indicated in FIG. 3, near the point at which they enter the spinning stations 1, 1'. In the specific case shown herein, the photoelectric barrier 23 has ascertained that no sliver is entering the spinning station 1'. This means that the rear sliver can 3' has run empty, or is no longer resupplying any sliver. This is the signal for changing the sliver can 3'.

As soon as the photoelectric barrier 23 has ascertained that no sliver is entering the spinning station 1', it activates the photoelectric barrier 24 through the control device 51. This barrier 24 is then oriented toward the next guide rail in succession, namely the guide rail 63. At the same time, the control device 51 switches the positioning device 12 to crawling speed. As soon as the photoelectric barrier 24 is located in front of the guide rail 63, as shown in FIG. 2, it causes the motor 12 to be switched off and firmly braked, through the control device 51. The can transport carriage 6 is then stopped in front of the automatic spinning machine in such a way that the can changer 21 is in alignment with the pair of cans 3, 3' of the pair of spinning stations 1, 1' as FIG. 1 shows. At the same time, the free parking places A and D are then in alignment with the parking places 2, 2' of the cans 3, 3'. In order for this to be true, the turntable 16 may perhaps have to have been rotated beforehand into the position shown in FIG. 2.

Once the time necessary for this has elapsed, the actual can changing program begins, as will be described in further detail below in conjunction with FIGS. 4 through 7.

In order to transport the cans, the can grippers 39 first swivel out of their horizontal position above the plane 22 into the vertical position, while being controlled by the control device 51 and with the aid of the drive mechanism 40, whereupon the manipulator 34 moves forward in the direction of the arrow 58 far enough so that the can grippers 39 are at the transfer point E or in a loading position F or G, and in any case in a position in which a can can be grasped and transported to some other location. In order to seize a can, both can grippers 39 swivel inward and in the process clamp the can firmly at the level of a bulging rim 57. For instance, if this takes place in the loading position F of FIG. 1, then the manipulator 34 next moves counter to the direction of the arrow 58, according to the program, until the can grippers 39 are in the position E. During transport, it is also possible to raise the can somewhat, but this is not absolutely necessary.

After the clamping has been undone, the manipulator 34 then moves the can grippers 39 into a neutral position at the level of the pivot axis 15'. Subsequently, the can grippers are swung upward until they are above the plane 22. Next, the control device 51 causes the remaining actions to be carried out, the first being turning the turntable 16 in the direction of the arrow 50, in accordance with the program.

The can changing program will be described in further detail below, while referring to FIGS. 4 through 7. Each of these figures is a view from above which schematically shows the location of filled and empty cans and free parking places on the can transport carriage 6 and on the platform 60 below the spinning stations 1, 1' of FIGS. 1 through 3.

In order to change an empty can 3' located at the rear, an outset position of the turntable is assumed, as shown in a position a of FIG. 4, in which the two filled sliver cans 27 and 28 are oriented toward the pair of cans 3, 3'. This outset position of the turntable is indicated by an angle marking 0°.

In preparation for changing the can 3', the turntable is first rotated onward by 90° in the direction of the arrow 50, as shown in a position b of FIG. 4. The two empty parking places A and D are then aligned with pair of cans 3, 3', so that the can 3 which is still delivering the sliver 4 can first be moved to the previously empty parking place A, as shown in the position b of FIG. 4. Subsequently, the turntable is rotated onward in the same direction by 90°, so that then as shown in a position c of FIG. 4 it has reached a 180° angle. The empty can 3' can then be placed on the second empty parking place D of the turntable, as the position c of FIG. 4 shows. The two parking places 2, 2' under the pair of spinning stations are then free, so that the parking place 2' can first be occupied by the filled can 27. To this end, as a position d of FIG. 4 shows, the turntable can be rotated onward, still in the same direction of rotation, by 180°, so that it then is at a 360° position, which is equal to the 0° position, as shown in the position d of FIG. 4. The can changer then transports the filled can 27 from the parking place A to the parking place 2', as the position d of FIG. 4 again shows.

Subsequently, the can 3 that has been picked up temporarily must be returned to its parking place 2. To this end, the turntable is rotated onward by another 90°, as shown in a position e of FIG. 4. As a result, the parking place A with the can 3' parked on it is caused to face the parking place 2, and the can changer is then able to return the can 3, as a position e of FIG. 4 shows.

The can transport carriage then merely needs to release the filled can 28, and in order to ensure that this can be accomplished by the same method, it is suitable to rotate the turntable onward by another 180°, so that it assumes a 270° position shown in a position f of FIG. 4.

FIG. 5 shows how the can change is carried out if the can transport carriage has only loaded an empty can L1 next to a filled can 28. The various positions and operations are equivalent to those of FIG. 4. As in FIG. 4, it is the rear can 3' that is changed.

FIG. 6 shows the replacement of the front can 3. An outset location of a position a of FIG. 6 is the same as in a position a of FIG. 4.

The can changing program then proceeds somewhat differently because two intermediate positions are skipped. From the starting position, the turntable is immediately rotated 180° in the direction of the arrow 50 to the location of a position c of FIG. 6. In this position, the empty can 3 is moved to the free parking place D, as shown in a position c of FIG. 6. In order to transfer the can 27, the turntable is then rotated onward in the same direction by 180°, so that it assumes the 360° position which is equal to the 0° position shown in a position d of FIG. 6. In this position, the filled can 27 is moved from the parking place B to the parking place 2. In order to ensure that the next subsequent can changing operation can proceed in the same way, the turntable is finally rotated onward by 270° (or alternatively rotated backward by 90°), resulting in the location of a position f of FIG. 6 at an angle of 270°.

FIG. 7 shows the can changing operation in the case where an empty can L1 is already located next to the still-filled can 28. The can changing method is the same as in FIG. 6, except that in this case the filled can 28 is released and from the outset the parking places A and B are free, instead of the parking places D and A.

It is advantageous for several reasons to perform the can changing method in such a way that the can scheduled to be released next assumes a certain basic position. In the present exemplary embodiments, this basic position in each case is below the transfer point E of the can changer 21. An outset position as in the position b of FIG. 4 and the position b of FIG. 5 could also be selected. In the methods of FIGS. 4 and 5, one indexing step could then be saved. However, whether or not this is practical depends on other conditions as well, and primarily on the location of non-illustrated loading or unloading stations for the can transport carriage 6. Otherwise, the indexing steps that might be saved in can changing at the automatic winding machine would have to be additionally carried at the loading or unloading station for the can transport carriage 6, in order to place the turntable 16 in an advantageous loading position.

Although it is always simple to rotate the turntable 16 onward in only one direction, all that is necessary in principle is to move the turntable into a certain rotational angle position at a given time. In an individual case, this could also be accomplished by selectively turning the turntable in either rotational direction. For instance, instead of rotating the turntable 270° in one direction, it could equally successfully be rotated 90° in the other direction. However, this would entail increased expenditure for switching means, and in any case increased expenditure for programming. Under some circumstances, difficulties might arise in guiding the still-traveling sliver.

I claim:

1. In a method for supplying an automatic spinning machine with filled sliver cans and for removing cans that become empty at spinning stations of the automatic spinning machine with the aid of a can transport carriage which is to be driven between the automatic spinning machine, a can delivery station and an empty can receiving station and which has can parking places for a can supply, which includes removing an empty can located below a spinning station, placing the empty can on a free parking place, replacing the empty can with a filled can from the can supply, and placing the filled can under the spinning station, with an automatic can changer, the improvement which comprises providing the parking place changer in the form of a turntable being drivable in controlled fashion on the can transport carriage; defining at least four parking places for cans about a pivot point of the turntable; loading the turntable at a can delivery station and maintaining two free parking places when the turntable is loaded at the can delivery station; placing each of two sliver cans of a row of sliver cans in association with a respective one of two adjacent spinning stations such that the row of sliver cans together with a pair of sliver cans already under the respective spinning stations form a group of two rows of front and rear sliver cans; maintaining two free parking places for sliver cans on the can transport carriage; changing a rear can of the pair of cans located at the spinning stations by initially loading both cans of the pair onto the two free parking places with the can changer, regardless of whether or not the front can in a front position is still delivering sliver to one of the spinning stations; retaining the front can on the parking place on the turntable without interrupting a flow of sliver from the front can to the respective spinning station and simultaneously replacing the empty rear can of the pair of cans with a full can; and subsequently returning the front can of the pair of cans to the front position at the spinning stations with the can changer.

2. The method according to claim 1, which comprises reporting a need to be changed for at least one of the pair of cans; aligning the can changer in front of the pair of cans; then transporting one can after another from the adjacent spinning stations to the can transport carriage or from the can transport carriage to the pair of spinning stations with the can changer; and then providing either a filled can or a free parking place on the can transport carriage with the can changer and a parking place changer for each transport event.

3. The method according to claim 2, which comprises providing a sensor and controlling at least one of the can changer and the parking place changer with information obtained from the sensor.

4. The method according to claim 2, which comprises controlling movements of at least one of the can changer and the parking place changer according to a predetermined can changing program coordinating the movements.

5. The method according to claim 4, which comprises providing varying courses of motion in the can changing program in dependence on whether a rear can or a front can of a pair of cans is being changed.

6. The method according to claim 1, which comprises loading the turntable with filled or emptied cans in such a way as to locate the free parking places adjacent one another on the turntable after ending the loading or changing process.

7. The method according to claim 1, which comprises placing the empty can on the turntable as a last can of a row of cans and releasing a first can of the row of cans, in each can changing operation.

8. The method according to claim 1, which comprises placing a front can still delivering sliver on the turntable next to the filled can to be released, before a rear can of a pair of cans is changed; then placing the empty can beside the can still delivering sliver; subsequently releasing the filled can; and finally returning the can still delivering sliver to its place below the pair of spinning stations.

9. The method according to claim 1, which comprises successively moving the turntable to positions in which a can or a free parking place, as required, is located at a can transfer point when a can is being changed.

10. The method according to claim 9, which comprises guiding moving sliver of a can still delivering sliver over a can rim and outside or underneath transport or gripper elements of the can changer, whenever the can still delivering sliver is temporarily placed on the can transport carriage.

11. An apparatus for supplying an automatic spinning machine with filled sliver cans and for removing sliver cans becoming empty at spinning stations of the spinning machine, comprising sliver cans; a can transport carriage to be driven between the automatic spinning machine, a can delivery station and an empty can receiving station, said can transport carriage having a parking place changer with a turntable being drivable in controlled fashion, said turntable having at least four parking places for sliver cans being disposed around a pivot axis, two of said parking places remaining free during can transport; a pair of front and rear sliver cans being disposed at front and rear positions, respectively under a pair of adjacent spinning stations for furnishing sliver in each of said front and rear sliver cans to one of the two spinning stations of the pair of spinning stations; and an automatic can changer having means for initially loading both of said sliver cans of a pair of sliver cans onto two free parking places maintained on said transport carriage prior to changing said rear can of said pair of sliver cans, regardless of whether or not said front sliver can of said pair of sliver cans is still delivering sliver to a spinning station of the associated pair of spinning stations, then replacing an empty one of said sliver cans with a filled one of said sliver cans, and subsequently returning said front sliver can of said pair of sliver cans to the front position at the spinning station.

12. The apparatus according to claim 11, including positioning rails disposed laterally beside successive sliver cans forming a pair of said sliver cans below the spinning stations.

13. The apparatus according to claim 11, wherein said can transport carriage has a positioning device for positioning said carriage to change said sliver cans and for placing said can changer in alignment with said pair of sliver cans at the pair of spinning stations.

14. The apparatus according to claim 13, wherein said can transport carriage has a parking place changer making a filled sliver can or a free parking place available to said can changer for each changing operation, and including at least one sensor for at least one of recognizing and distinguishing among empty cans, filled cans and free parking places, whether or not sliver is running into the spinning station, said sensor controlling at least one of said positioning device, said can changer and said parking place changer.

15. The apparatus according to claim 11, wherein said can changer has means for successively transporting individual cans from the pair of spinning stations to said can transport carriage and back again.

16. The apparatus according to claim 11, wherein said can transport carriage has a parking place changer providing a filled sliver can or a free parking place to said can changer for each changing operation.

17. The apparatus according to claim 16, wherein said parking place changer and said can changer have operating elements, and including a programmable control device connected to at least one of said can changer and said parking place changer for coordinating and controlling movements of said operating elements of at least one of said parking place changer and said can changer in accordance with a predetermined can changing program.

18. The apparatus according to claim 17, wherein said can changing program has different variants of a course of movement depending on whether a rear can or a front can of said pair of sliver cans is to be changed.

19. The apparatus according to claim 16, including a transfer point defined on said can changer on said can transport carriage, and wherein said parking place changer is successively controllable for locating a sliver can or a free parking place at or below said can transfer point as needed for a can transfer operation.

20. The apparatus according to claim 11, wherein said can changer operates in or above a given plane located above a can parking area, and said can changer has manipulating or gripper elements being movable to a plane located above the can parking area after the end of a manipulation operation.

21. A method for supplying an automatic spinning machine with filled sliver cans and for removing cans that become empty at spinning stations of the automatic spinning machine with the aid of a can transport carriage which is to be driven past the automatic spinning machine and which has can parking places for a can supply, and an automatic can changer having a parking place changer with a turntable being drivable in controlled fashion, said turntable having at least four parking places for sliver cans being disposed around a pivot axis, two of said parking places remaining free during can transport, the method which comprises placing a pair of sliver cans in the vicinity of two associated spinning stations such that the pair of sliver cans together with another pair of sliver cans disposed under the respective spinning stations form a group of two rows of front and rear sliver cans for supplying two adjacent spinning stations with sliver; maintaining two free parking places for sliver cans on the turntable of the can transport carriage; changing the rear can of the pair of cans located at the spinning stations by initially loading both cans of the pair onto the two free parking places with the can changer, regardless of whether or not the front can at a front position is still delivering sliver to the spinning stations; retaining the front can on the parking place on the turntable without interrupting a flow of sliver from the front can to the respective spinning station and simultaneously replacing the empty rear can of the pair of cans with a full can; and subsequently returning the front can of the pair of cans to the front position at the pair of spinning stations with the can changer.

22. An apparatus for supplying an automatic spinning machine with filled sliver cans and for removing sliver cans becoming empty at spinning stations of the spinning machine, comprising sliver cans; a can transport carriage to be driven past the automatic spinning machine front and rear sliver cans being disposed under a pair of adjacent spinning stations for furnishing sliver in each of said sliver cans to one of the two spinning stations of the pair of spinning stations; and an automatic can changer having a turntable being drivable in controlled fashion, said turntable having at least four parking places for sliver cans being disposed around a pivot axis, two of said parking places remaining free during can transport, said automatic can changer having means for initially loading both of said sliver cans of a pair of sliver cans onto two free parking places maintained on said can transport carriage prior to changing said rear can of said pair of sliver cans, regardless of whether or not said front sliver can of said pair of sliver cans is still delivering sliver from a front position to a spinning station of the associated pair of spinning stations, retaining the front can on the parking place on the turntable without interrupting a flow of sliver from the front can to the respective spinning station and simultaneously replacing an empty one of said sliver cans with a filled one of said sliver cans, and subsequently returning said front sliver can of said pair of sliver cans to the front position at the spinning station.

* * * * *